United States Patent [19]

Gregory

[11] Patent Number: 5,040,380

[45] Date of Patent: Aug. 20, 1991

[54] METHOD AND APPARATUS FOR THE SENSING OF REFRIGERANT TEMPERATURES AND THE CONTROL OF REFRIGERANT LOADING

[75] Inventor: Charles Gregory, Burlington, Canada

[73] Assignee: Super S.E.E.R. Systems Inc., Burlington, Canada

[21] Appl. No.: 404,380

[22] Filed: Sep. 8, 1989

Related U.S. Application Data

[63] Continuation-in-part of Ser. No. 229,038, Aug. 4, 1988, abandoned.

[51] Int. Cl.[5] ..... F25B 41/04; G01K 1/16

[52] U.S. Cl. ..... 62/225; 62/527; 165/908; 374/135; 374/147

[58] Field of Search ..... 62/225, 224, 524, 525, 62/527, 212, 210, 222; 374/147, 148, 138, 135; 165/908, 133, 907, 154, 109.1; 236/93 R, 92 B, 93 A

[56] References Cited

U.S. PATENT DOCUMENTS

| | | | |
|---|---|---|---|
| 2,099,186 | 11/1937 | Anderegg | 62/524 X |
| 2,110,430 | 3/1938 | Swanson | 62/525 X |
| 2,120,764 | 6/1938 | Newton | 62/524 X |
| 2,139,297 | 12/1938 | Bergdoll | 62/524 X |
| 2,218,594 | 10/1940 | White | 62/141 |
| 2,983,107 | 5/1961 | Forrest | 62/53 |
| 3,411,315 | 11/1968 | Sahle | 62/224 |
| 3,555,845 | 1/1971 | Huelle | 62/527 X |
| 3,623,367 | 11/1971 | Benedict | 374/135 X |
| 3,732,704 | 5/1973 | Morgan | 62/202 |
| 3,740,967 | 6/1973 | Huelle | 62/527 |
| 3,908,628 | 9/1975 | Lazaridis et al. | 165/154 X |
| 3,938,349 | 2/1976 | Ueno | 62/197 |
| 4,047,379 | 9/1977 | Brookes et al. | 374/135 X |
| 4,229,949 | 10/1980 | Brandin | 62/527 X |

FOREIGN PATENT DOCUMENTS

| | | | |
|---|---|---|---|
| 0734702 | 8/1955 | United Kingdom | 374/148 |

*Primary Examiner*—Harry B. Tanner
*Attorney, Agent, or Firm*—Rogers & Scott

[57] ABSTRACT

A new method and apparatus are provided for sensing refrigerant temperatures in refrigerator systems, and for preventing underloading of the coil, or of any of the coils in a plurality of refrigerator evaporator circuit coils connected in parallel. The usual thermostatically controlled refrigerant flow control valve is controlled by a thermostatic sensor to ensure a predetermined minimum amount of superheat, usually about 5.5° C. (10° F.). To avoid underloading the refrigerant is rendered thoroughly turbulent and mixed, and in the multi-coil evaporator the flows from all of the coils are similarly thoroughly turbulated and mixed, by a turbulating and/or mixing device that intercepts the entire refrigerant flow just before the sensing of the superheat, thus ensuring that the temperature is accurately measured; in the multi-circuit coil system the device averages the temperatures of all the flows. Different turbulator/-mixer devices are described and two or more such devices may be used in series. The superheat can now be reduced to about 2° C. (4° F.), the efficiency is increased, and close matching between valve size and coil loading is no longer required.

46 Claims, 3 Drawing Sheets

METHOD AND APPARATUS FOR THE SENSING OF REFRIGERANT TEMPERATURES AND THE CONTROL OF REFRIGERANT LOADING

CROSS-REFERENCE TO RELATED APPLICATION

This application is a Continuation-In-Part of U.S. application Ser. No. 07/229,038 filed 4th August 1988 which is now abandoned.

FIELD OF THE INVENTION

This invention is concerned with a method and apparatus for the sensing of refrigerant temperatures in refrigerator systems and particularly with a method and apparatus for the control of refrigerant loading in refrigerator evaporators.

REVIEW OF THE PRIOR ART

The standard refrigeration compressor-operated system consists of a closed circuit in which cool low-pressure refrigerant vapour from a suction line enters a compressor which compresses it to a hot high pressure vapour, this hot vapour then flowing through a discharge line to a condenser coil or coils where it is cooled below its condensing temperature and becomes liquid. The liquid flows from the condenser through a return line into a liquid receiver, and from the receiver through a liquid line to an indicator and filter/drier, from whence it passes to a thermostatically controlled expansion valve which maintains at an optimum value the flow of the liquid refrigerant into an evaporator coil or coils, in which it evaporates with consequent temperature drop and cooling of the coils and their environment; the resultant vapour passes through the suction line back to the compressor to complete the circuit.

It is essential to control the expansion valve (usually called the TX valve) so as to prevent any liquid refrigerant from reaching the compressor, which would damage it, and this valve control usually consists of a remote temperature sensing fluid-containing bulb connected by a metal capillary tube to a charged diaphragm capsule in the valve. The capsule responds to changes in temperature of the sensing bulb to regulate the flow through the valve. Equivalent electrical sensors have also been developed. The sensor bulb or its equivalent normally is clamped tightly to the suction line at the exit from an outlet manifold into which the evaporator coil or group of coils discharge so as to sense the temperature of the vapour at this point. The temperature characteristic of a vapourizing body of liquid is very standard in that its temperature will remain relatively constant at about the respective vapourizing (saturation) temperature as long as there is some liquid present to vapourize, and then will rise relatively rapidly when all the liquid is gone. To ensure that no liquid escapes from the evaporator the sensor is set for an operating temperature sufficiently higher than the saturation temperature, and the difference between these two temperatures is known as the superheat. As an example, a quite usual range of values for the saturation temperature of such a system is about −7° C. to about 4.5° C. (20° F. to 40° F.), while a quite usual value for the superheat is about 5.5° C. (10° F.), so that the range of control temperatures for such systems will be −1° C. to 10° C. (30° F. to 50° F.).

In theory it should be possible to use a much lower superheat value, say 1° C. (2° F.), but it is found in prior art practice that this has not been sufficient to ensure the complete absence of liquid refrigerant from the evaporator manifold outlet and the higher value is therefore almost universally used. As the superheat value varies around the predetermined amount the TX valve opens and closes, and in theory should be operable to maintain it quite accurately at that value, but in practice there is a time lag between the sensing of the temperature by the sensor and the operation of the TX valve, which also usually cannot respond fast enough, resulting in a fluctuating superheat value necessitating the higher amount, thereby reducing the efficiency of the system. There is therefore a continuing need for a temperature sensor for such systems which can more accurately determine the temperature of the refrigerant vapour in the suction line and thus improve the efficiency.

In commercial refrigerators, most evaporators consist of a large number, often as many as fifty, separate "circuit coils" connected in parallel so as to obtain sufficient cooling capacity without the individual coils being of too great length with consequent high pressure drop. These circuit coils are arranged in sets, each set having its own expansion valve and a common distributor interposed between the valve and the coils of the set, the purpose of the distributor being to divide the flow as equally as possible between individual small diameter feed pipes of equal length leading from the distributor to the respective circuit coil pipe inlets. All of the circuit coil pipe outlets are connected to a common outlet manifold or stand-pipe. Despite the care that is taken to try to make the valve and distributor feed equal amounts of liquid refrigerant to the circuit coils, and to make all of the circuit coils as equal in length and flow characteristic as possible, it is in practice always found that liquid refrigerant vapourizes in some of the coils at a different rate than in the others, due to variables such as differences in the flow of air over the different coils, and small differences in the pressure drop through each coil. The consequence is that the circuit coil or coils which absorb the least amount of ambient heat allow the liquid refrigerant to flow further along it or them before vapourizing, so that it is this coil or coils that control the TX valve and close it down, starving the remainder of the coils of liquid refrigerant and excessively superheating the refrigerant vapour in the starved coils, and thereby reducing the cooling capacity of the system. This reduction can be as much as from about 25 to 35% of the total capacity.

This unequal loading of the evaporator circuit coils can usually be observed by visual inspection of the coils once the system has been in operation of a short time, when the starved circuit coils are less frost coated toward the outlet end than the others. This unequal loading is often mistakenly attributed to unequal distribution of the refrigerant liquid among the coils.

There are disclosed in U.S. Pat. Nos. 3,555,845 and 3,740,967, both issued to Danfoss A/S of Denmark, a forced flow evaporator for compression type refrigerating equipment in which part of the evaporator tube, or a tube immediately following the evaporator tube, has its inner wall lined with gauze fabric to provide a capillary system that will absorb any liquid refrigerant, the gauze fabric occupying less than one-half of the cross-sectional area of the tubing, so that a substantial central passage is left through which the vapour passes at high speed without mixing with the liquid retained by the gauze fabric, which thereby effectively forms a relatively stagnant layer on the wall of the tube.

U.S. Pat. No. 4,229,949, issued to Stal Refrigeration AB of Sweden, discloses a refrigerator system in which a flow disturbing element is located in the suction pipe downstream of the evaporator, the element operating on the fluid in the pipe to give the two phases found therein, namely liquid particles and superheated vapour, an increased mutual relative speed to increase the the heat transfer rate between them and ensure that the refrigerant exits exclusively in the vapour phase. This element consists of a disc provided with openings and arranged perpendicularly to the flow direction of the refrigerant, the disc creating turbulence that accelerates the temperature equalisation.

DEFINITION OF THE INVENTION

It is therefore a principal object of the present invention to provide a new method and apparatus for the sensing of refrigerant temperatures in refrigerator systems, and in particular a new method and apparatus by which the temperature of the refrigerant exiting from an evaporator coil is sensed more efficiently by the temperature sensor controlling the TX valve for more precise superheat control.

It is another principal object to provide a new method and apparatus for the control of refrigerant loading in refrigerator evaporator coils.

In accordance with the present invention there is provided a method for the sensing of the temperature of refrigerant exiting from a refrigeration system evaporator coil outlet and for the control in accordance with the sensed temperature of a controllable evaporator valve feeding liquid refrigerant to the evaporator coil inlet, the method comprising:

feeding the refrigerant from the coil outlet to the interior of a turbulating and mixing device having therein a refrigerant flow path and having at least part of a wall thereof of heat conductive material for sensing the device interior temperature through the wall part;

producing in the flow path turbulence and mixing of the refrigerant by turbulence and mixing producing means that intercept the entire refrigerant flow and that changes the direction of the entire refrigerant flow to ensure turbulence and mixing of all liquid and vapour refrigerant phases present in the refrigerant flow and contact of only mixed phases with the wall part; and sensing the device interior temperature at the wall part by temperature sensing means and controlling the evaporator valve in accordance with the sensed temperature.

Also in accordance with the invention there is provided apparatus for the sensing of the temperature of refrigerant exiting from a refrigeration system evaporator coil outlet and for the control in accordance with the sensed temperature of a controllable evaporator valve feeding liquid refrigerant to the evaporator coil inlet the apparatus comprising:

a turbulating and mixing device having an inlet and an outlet for refrigerant and having therein a refrigerant flow path having at least part of a wall thereof of heat conductive material for sensing the device interior temperature through the wall part;

turbulence and mixing producing means in the flow path intercepting the entire refrigerant flow and creating turbulence and mixing of the refrigerant with changes in the direction of the entire refrigerant flow to ensure turbulence and mixing of all liquid and vapour refrigerant phases present and contact of only mixed phases with the wall part; and the apparatus being adapted to have in heat conductive contact with the wall part temperature sensing means for sensing the device interior temperature and for controlling the evaporator valve in accordance with the sensed temperature.

Further in accordance with the invention there is provided a new method for the control of refrigerant loading in a refrigerator evaporator coil comprising a plurality of circuit coils connected in parallel with one another and all supplied with refrigerant through a common thermostatically controlled refrigerant flow control valve and refrigerant distributor, the valve being controlled to control the refrigerant flow by a superheat temperature sensor detecting the average temperature of the refrigerant from all of the circuit coils, characterized in that at or prior to the detection of the temperature by the sensor the refrigerant flows from the circuit coils are mixed by a turbulating and mixing device to provide vapourization of any liquid phase refrigerant present by any superheated vapour phase refrigerant present average the temperatures of the flows.

Further in accordance with the invention there is provided apparatus for use in a refrigeration system comprising:

a refrigerant compressor;

a condenser coil receiving refrigerant from the compressor to cool it;

a common, thermostatically controlled refrigerant flow control valve receiving the cooled refrigerant from the condenser coil;

an evaporator coil comprising a plurality of circuit coils connected in parallel with one another so that all are supplied with refrigerant from the common control valve;

a common member having an inlet and an outlet receiving the refrigerant exiting from all of the circuit coils; and conduit means connecting the compressor, condenser coil, common control valve, evaporator coil, common member inlet, common member outlet and the compressor in a closed loop in the order stated;

a superheat temperature sensor detecting the temperature of the refrigerant at the common member outlet and operatively connected to the control valve for control thereof;

the apparatus comprising the said turbulating and mixing device in the said loop at the common member outlet and turbulating and mixing the refrigerant flows from the circuit coils to average the temperatures of the flows, the temperature sensing means sensing the device interior temperature.

DESCRIPTION OF THE DRAWINGS

Methods and apparatus of the invention will now be described, by way of example with reference to the accompanying schematic and diagrammatic drawings, wherein.

The same or similar parts are given the same reference in all the figures of the drawing, wherever that is possible.

DESCRIPTION OF THE PREFERRED EMBODIMENTS

Figure 1:
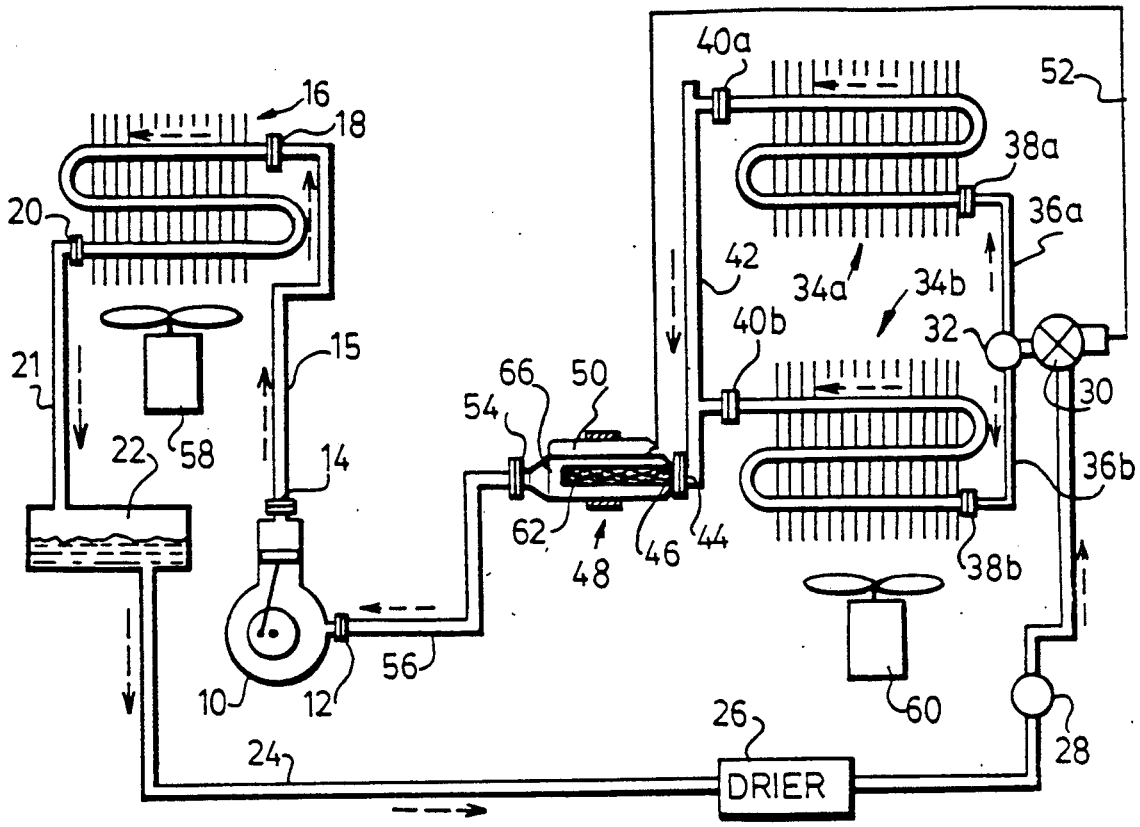
FIG. 1 is a schematic diagram illustrating a typical refrigeration system and including a device that is a first embodiment of the invention.

Referring now to FIG. 1, a typical refrigeration system to which the method and apparatus of the invention can be applied comprises a refrigerant compressor 10 having a suction inlet 12 and a high pressure outlet 14, the compressor feeding the hot compressed refrigerant fluid via conduit 15 to a condenser coil 16 having an inlet 18 and an outlet 20. Cooled refrigerant from the coil 16 passes via conduit 21 to a liquid accumulator 22, and thence via conduit 24 through a filter/drier 26, a liquid indicator 28 and a common thermostatically controlled refrigerant flow control TX valve 30 into a distributor 32, from which it flows into two parallel-connected circuit coils 34*a* and 34*b* of an evaporator coil. For convenience in illustration only two circuit coils are shown, but in practice there can be as many as fifty in a single large evaporator coil, each circuit coil being connected by a respective inlet pipe 36*a* and 36*b* to the common distributor 32. Again in practice care is taken to make all of the circuit coils 34*a*, 34*b*, etc., and all of the pipes 36*c*, 36*b*, etc., of the same length and as equal as possible, so that the refrigerant will be distributed as equally as possible among them.

Each circuit coil has an inlet 38*a*, 38*b* respectively and an outlet 40*a* and 40*b* respectively, the latter all being connected to a common header pipe 42 (sometimes also called a stand-pipe or manifold), the single outlet 44 of which is connected to inlet 46 of a turbulator and mixing device 48 of the invention. A superheat temperature sensing bulb 50 by which the TX valve 30 is controlled is tightly clamped to the exterior of the device 48 by a clamp 51 to be in good heat exchange with its interior and is connected by a capillary tube 52 to the valve 30. The outlet 54 of the device 48 is connected by conduit 56 to the pump inlet 12 to complete the system circuit. The usual fans 58 and 60 are provided to circulate ambient air over the coils 16 and 34*a*, 34*b* respectively. The numerous other circuit elements, controls and indicating devices that such a system normally includes do not constitute part of this invention and therefore do not need to be illustrated. The direction of flow of the refrigerent is indicated by the broken arrows.

Figure 2:
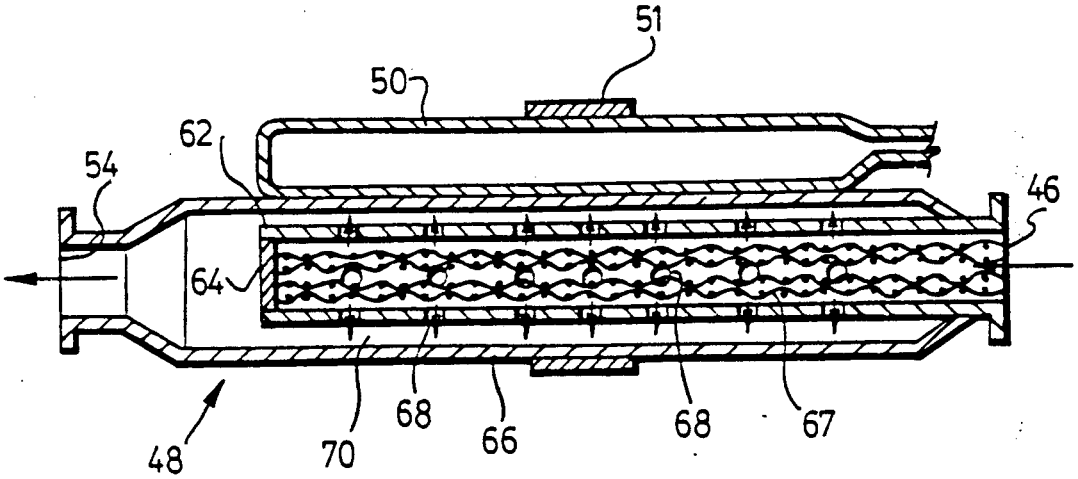
FIG. 2 is a longitudinal cross-section to a larger scale of the device of FIG. 1.

Referring now also to FIG. 2, this particular device 48 is made of high conductivity metal, such as copper or brass, and consists of a first inner cylindrical pipe 62, one end of which is flanged and constitutes the inlet 46, and the other end 64 of which is closed. A second outer cylindrical pipe 66 of larger diameter surrounds the first inner pipe coaxial therewith and is sealed to the pipe at one end adjacent the inlet 46, while the other end is flanged and constitutes the outlet 54. The interior of the inner pipe is filled with a spirally wound coil 67 of stainless steel open mesh material. The inner pipe has a plurality of holes 68 distributed uniformly along its length and around its periphery, which holes direct the refrigerant vapour entering the inlet 46, together with any liquid entrained therein, forcibly against the inner wall of the outer pipe 66. The pipes and the bores therefore provide within the interior of the device a direction-changing flow path between the inlet and the outlet, the combination of the multitude of tortuous paths formed by the mesh coil 67, the abrupt changes in direction of the fast-flowing fluid, the turbulence in the inner pipe 62 because of the impingement of the fluid against the closed end, and the turbulence in the annular chamber 70 between the two pipes because of the said impingement against the outer pipe inner wall, ensuring that the entire refrigerant flow in the flow path, whether in the liquid or vapour phase, is all thoroughly mixed and rendered turbulent, and particularly without any possibility of the relatively high velocity vapour phase being able to flow through the device separately from the liquid phase. Moreover, the vigorous impingement of the high velocity fluid against the outer pipe inner wall ensures that any relatively stagnant barrier layer of refrigerant, or of the lubricating oil that is always entrained therein, is thoroughly disrupted and removed from the inner wall, so that it cannot prevent the efficient transfer of heat from the refrigerant through the wall to the sensor bulb 50. The bulb is therefore sensing only the temperature of a completely turbulent mixed and temperature averaged refrigerant flow as received from the outlet of the headeer pipe 42, and in addition is much more sensitive to changes in the refrigerant temperature and more accurately measures the device interior temperature which corresponds to the averaged refrigerant temperature. This turbulating and mixing function of the device 48 is effective in this manner whatever the evaporator coil structure employed in the system.

When the device is used with a system as specifically described, namely with multiple circuit coils, then in addition to turbulating and mixing the fluid flow in each evaporator circuit coil it also performs a multiple mixing function, whereby the fluid flows from all of the circuit coils are thoroughly mixed together, so that all of their separate temperatures are averaged, and it is this average circuit coil temperature that is detected by the bulb 50. Moreover, this very thorough turbulence and mixing ensures that if one or more of the circuit coils is not evaporating all of its supply of refrigerant, then the small quantities of liquid reaching the mixing device are immediately atomized and consequently easily vapourized by heat from the superheated vapour from the remaining coils. The supply of refrigerant to the strarved coil or coils can therefore be increased until the superheated vapour they produce is not able to vaporise the liquid refrigerant from the underloaded coil or coils.

The diameters of the pipes 62 and 66 are such that the flow capacities of the resultant flow passages are about that of the remainder of the suction tube 56, while the number and size of the apertures 68 are such that about the same flow capacity is achieved. These flow capacities can vary between about 0.5 and 1.5 times the usual flow capacity of the suction tube; it may be preferred to reduce the flow capacity of the apertures 68 somewhat below that of the suction tube in order to obtain sufficiently forceful impingement of the fluid against the outer tube inner wall.

In one specific embodiment intended for use in a system of about 3–5 h.p. the outer pipe 66 is about 20–25 cm (8–10 ins.) long and 4.0 cm. (1.6 ins.) outside diameter; the inner pipe 62 is 2.75 cm (1.1 in.) outside diameter and is provided with 40 uniformly spaced holes 68 of 0.47 cm (0.19 ins.) diameter. The mesh insert 67 consisted of a piece of stainless steel fine wire mesh corrugated diagonally to its length measuring 10 cm by 15 cm (4 ins. by 6 ins.) wound into a spiral sufficiently tightly to permit its insertion into the pipe, where it will expand to completely fill the space. It will be understood that it is not possible to accurately illustrate such a tightly rolled spiral in the drawings.

In another embodiment intended for a system of about 10–15 h.p. the outer pipe 66 is 5.25 cm (2.1 in.) outside diameter, the inner pipe 62 is 4.0 (1.6 in.) outside diameter and the holes 68 are 0.6 cm (0.25 in.) diameter. It is found in practice that the pressure drop through the devices of the invention is sufficiently low, usually less than about 1 p.s.i., that it does not produce any appreciable loss of efficiency, and any loss for this reason is amply compensated by the overall considerably improved efficiencies that usually are obtained. The drop is sufficiently small that it is difficult, if not impossible, to detect with the pressure gauges that are used in standard refrigeration service practice.

Despite the lengthy period of time for which these problems have existed it does not appear to have been understood how to provide turbulator means and/or mixing means that will sufficiently improve the temperature detection and control of the TX valve, and also in multiple coil systems to average the temperatures of the refrigerant flows from the large number of individual circuit coils for the same purpose, and to the best of my knowledge none of the arrangements proposed in U.S. Pat. Nos. 3,555,845; 3,740,967 and 4,222,949 are in commercial use. Thus, the current literature in the industry of which I am aware seems to assume that all that can be done is to make the lengths of the circuit coils as equal as possible, to discharge all of the circuit coils into a common header pipe, and to clamp the sensor bulb to the outside of the outlet pipe from the header pipe, when the temperature will be measured as accurately as possible and the flows will be mixed to the maximum obtainable extent.

I believe that this mistaken assumption may have resulted from a lack of adequate appreciation of the flow conditions of the refrigerant fluid in the evaporator coils and the outlet pipe or manifold. The refrigerant enters the coils as a low volume liquid and is evaporated in the confined spaces thereof to a high volume vapour, with the result that the exit speed of the vapour is relatively high, to the extent that in the absence of the highly positive turbulating and/or mixing method and corresponding apparatus of the invention, involving the entire fluid flow or flows, the flows in the coils remain laminar and any liquid particles remain entrained without mixing, while there is little or no opportunity for the flows from the different coils to mix and average. Consequently there is little opportunity for any small quantities of liquid refrigerant to be evaporated, before the temperature must be sensed by the bulb 50. It is essential for the turbulating and mixing to be carried out across the entire cross-section of the flow path, since any gaps will allow the corresponding portion or portions of the high velocity fluid passing through them to remain laminar with liquid particles entrained and defeat the purpose of the device. The situation would not be made much better in the prior art apparatus by placing the sensor bulb 50 further along the suction pipe 56, since the flows will still remain relatively laminar along the pipe, and any additional distance of the bulb from the evaporator outlet and from the TX valve introduces additional difficulty because of the increased time delay for operation of the valve.

As evidence of this current lack of appreciation of the problem there is and has been considerable discussion of the best physical arrangement for the coils to ensure that are equally loaded, and it has been considered important in prior refrigeration systems to locate the sensor bulb 50 appropriately on the circumference of the suction pipe in order to sense the superheat temperature as accurately as possible and operate with minimum superheat. The manufacturers of TX valves in their installation manuals stress the importance of proper location of the sensor bulb, but do not give a definitive location for it. They advise that preferably the bulb should be fastened preferably to a horizontal portion of the suction line, and clamped at different places around its circumference at different places depending on the diameter, but the location is finally chosen by the installer depending upon what appears to be suitable and/or practicable for that installation, often with poor results. The theoretically ideal location is at 6 o'clock on the circumference of a horizontal suction pipe, where it should be able to sense most accurately any small quantity of liquid refrigerant passing in the pipe, and would therefore permit the smallest amount of superheat. In practice this has not been a satisfactory location because of the presence of lubricant oil in the refrigerant, which flows along the bottom of the pipe and would thermally insulate the sensor bulb from the refrigerant fluid. The usual location for the bulb has therefore been at four or eight o'clock on the pipe circumference. It is found that with the thorough turbulence and mixing provided that the location of the sensor bulb around the circumference of the device is quite immaterial, and it can be placed at the most convenient location from the point of view of installation as close to the valve as possible and subsequent access for service. It will also be seen that the sensor need not be located directly on the wall of the mixing device enclosure, which is the preferred location, but should be located as close as possible to the device outlet. In addition it is now found quite unnecessary to locate the sensor bulb on a horizontal portion of the suction line, and the attitude of the device has no effect upon its performance. It has also been found that the device is relatively insensitive to being installed so that the inlet is the outlet, and vice versa, although of course this is not recommended; a small decrease in efficiency of operation has been noted when this has occured.

The effectiveness of a device of the invention can readily be seen by visual inspection of the evaporator coil before and after its installation. Before installation it is usually found that the frost deposition on the different circuit coils is non-uniform with some of them completely frosted up to the outlet, while others are not frosted for a substantial distance back from the outlet, showing that the latter are starved of refrigerant and are working much below their maximum cooling capacity.

Also the evaporator common outlet member is only partially frosted. With the device installed all of the circuit coils become more or less equally frosted, as well as the entire length of the suction manifold, indicating that all of the circuit coils are now operating at their full designed capacity. It is now found possible safely to reduce the amount of superheat from the prior value of about 5.5° C. (10° F.) to as low as 2° C. (4° F.). In some installations the resultant improvement in cooling capacity of the system can reach as much as 25–35%, indicating that the system previously was operating at only 74–80% of the available capacity.

As a specific example, in an installation employing compressors totaling 200 H.P. and eight forced air evaporator coils the system prior to the installation of the devices of the invention took 3 hours, 10 minutes to cool the room temperature from 13° C. (55° F.) to −19° C. (−2° F.). With the devices installed the time taken was reduced to 2 hours, 10 minutes, an improvement of 29% in efficiency or equivalent to increasing the output of the compressors to about 258 H.P.

An important advantage that has been found to follow from use of the invention, demonstrating its unexpected nature, is the flexibility that is obtained upon installation in not having to closely match the size of the TX valve to the evaporator coil capacity without the valve losing control of the refrigerant flow. The capacity of a TX valve is determined both by the size of its flow aperture and the head pressure across the aperture, and it has been important in prior art installations for this match to be as close as possible. For example, one manufacturer provides 21 different sizes of valve to cover the range 0.5–180 tons, those in the range 0.5–3 tons being rated in 0.5 ton increments, with progressively increasing intervals up to the maximum. If the valve is too large then with the high superheat values employed the valve hunts, overfeeding and underfeeding the evaporator with resultant poor efficiency and danger of liquid reaching the compressor because of the over-large flow capacity of the valve while open. On the other hand, with the valve and coil sizes closely matched it becomes necessary to maintain the head pressure above a minimum value, since otherwise the valve flow capacity becomes too low. This penalizes the system in winter when the air cooled condensers are very efficient and could operate with lower head pressure; instead it is necessary to maintain it artifically high by various techniques that are available. This means that the power required to compress the refrigerant must also be maintained at a corresponding high uneconomical value.

This loss of control is easily observed in practice. For example, if the evaporator fan stops for some reason, perhaps a broken fuse, or the flow of product being cooled is interrupted, the load on the coil drops suddenly, faster than can be controlled by the valve, and liquid floods the compressor, which then becomes covered with frost when it should be frost-free. The liquid refrigerant washes out the lubricant, and can cause valve breakage and damage. Again, if the automatic coil defrost system is not operating satisfactorily and the coils become coated with ice the load on each coil drops and control can be lost; this of course is easily detected by visual inspection of the coils.

Upon installation of a device or devices of the invention it is found that this close match of load capacities is no longer necessary and an oversize valve can be employed successfully. In a specific example, in a system with a 1.5 ton evaporator the original 2 ton rated valve was replaced with an 8 ton rated valve; adequate control was maintained with the superheat value fluctuating about 0.5°–1° C. (1°–2° F.). Thus with a larger orifice TX valve it is no longer necessary to keep the head pressure at an artificially high value to maintain adequate refrigerant flow through the valve, and instead it could be allowed to drop to a lower level and still maintain proper superheat control with maximum evaporator capacity. This not only maximizes the efficiency of the system but also provides the possibility of reducing the number of different sizes of valves required for a full range of installation sizes.

Figure 3:
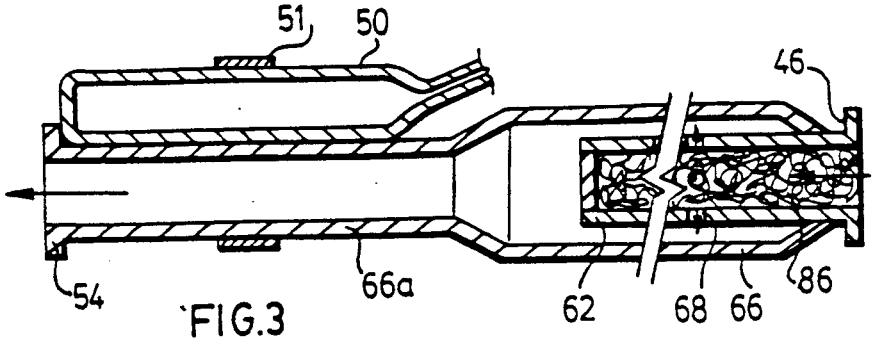
FIG. 3 is a cross-section similar to FIG. 2, illustrating a device that is a second embodiment.

As described above, the sensor bulb 50 preferably is installed on the device as close as possible to the device outlet 54 where the maximum mixing has occured. In the embodiment of FIG. 3 the external tube 66 is provided with an integral elongated neck portion 66*a* constituting the outlet 54 to facilitate fastening of the bulb to the device. In this embodiment the interior of the inner pipe 62 is completely filled with metallic wool 86 as a mixing medium, in place of the rolled screen of the embodiment of FIG. 1.

Figure 4:
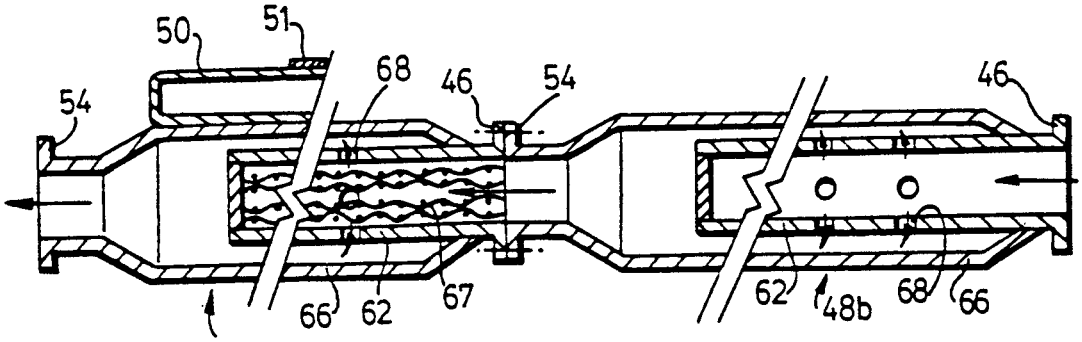
FIG. 4 is a longitudinal cross-section through an apparatus comprising two devices of FIG. 2 in series.

FIG. 4 shows another arrangement in which a second turbulating/mixing device 48*b* of the invention, of essentially the same body structure as the first device 48, now having the reference 48*a*, is connected in series with the first device, the sensor bulb 50 being installed on the downstream device 48*a*. The second device provides additional mixing with correspondingly improved performance of the TX valve, without too great an increase in pressure drop along the suction line, by suitable choice of the flow capacities of the respective internal passages and the bores 68. A mesh coil 67 (or body 86 of metallic wool) can be installed in either or both of the devices and is shown installed in device 48*a*.

Figure 5:
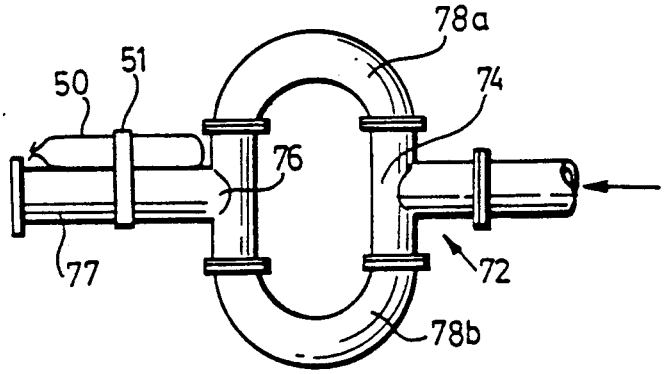
FIG. 5 is a longitudinal cross-section through a device that is a fourth embodiment.

FIG. 5 shows an embodiment in which the refrigerant flow path is provided by conduits forming two T-shaped junctions 74 and 76 connected by U-shaped connectors 78*a* and 78*b*; the connectors may be of smaller internal cross-section diameter to produce an increase in flow velocity of the refrigerant. The unction 74 divides the refrigerant flow from the common header 42 into two separate approximately equal sub-streams which are rendered turbulent by their impact against the transverse wall of the T cross-bar, the two streams moving separately at high velocity in the connectors 78*a* and 78*b* and being re-combined with a "head-on" collision in the cross-bar of the junction 76 back into a single stream. This collision of the two turbulent sub-streams produces even more turbulent mixing thereof, so that effective mixing and turbulence takes place before the refrigerant is delivered to the leg 77 of the second T-shaped junction to which the bulb 50 is attached. Although in this embodiment the refrigerant flow is divided into only two separate streams in other embodiments it may be divided into more than two, all of which are simultaneously or sequentially recombined.

Figure 6:
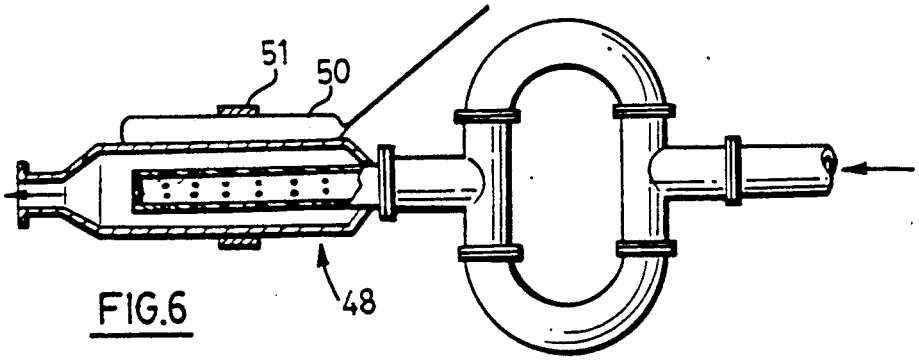
FIG. 6 is a longitudinal cross-section through an apparatus comprising a device of FIG. 5 in series with a device of FIG. 2.

FIG. 6 shows an arrangment in which the device 72 is followed by a device 48 so as to obtain the combined effect of the two devices, the bulb 50 being in this case attached to the downstream device 48.

Figure 7:
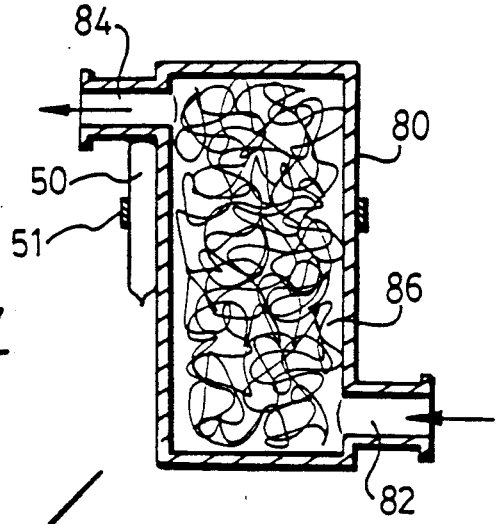
FIG. 7 is a longitudinal cross-section through a device that is a fifth embodiment.

FIG. 7 shows a further embodiment wherein the device consists of a container 80 having an inlet 82 for unturbulated, unmixed refrigerant and an outlet 84 for turbulent mixed refrigerant spaced from another along the length of the container, the inlet and outlet both being disposed radially with respect to the longitudinal axis of the container, so that abrupt changes in direction of the fluid flow path are produced. The interior of the container is filled with a porous turbulating and mixing medium 86 through which all of the refrigerant must pass in moving from the inlet to the outlet. The movement of the refrigerant fluid through the myriad of random interconnected channels in the medium 86 ensures the necessary thorough turbulence and/or mixing thereof. A suitable medium is for example metallic wools, foams or screens, or other suitable metallic media, particularly of stainless steel or aluminum, packed sufficiently densely to achieve the desired amount of turbulence and mixing without too great a pressure drop. Other media such as open-celled porous plastic and ceramic foams can also be used. Sensor bulb 50 is firmly clamped to the container exterior wall, which is sufficiently heat conductive, as close as possible to the outlet 84. In an example the container 80 was 10 cm (4 ins.) in diameter and 25 cm (10 ins.) long and was packed with stainless steel wool. Advantageously the body of wool is surrounded by at least a single layer of wire mesh to ensure that pieces of the wool cannot break off and enter the system.

Figure 8:
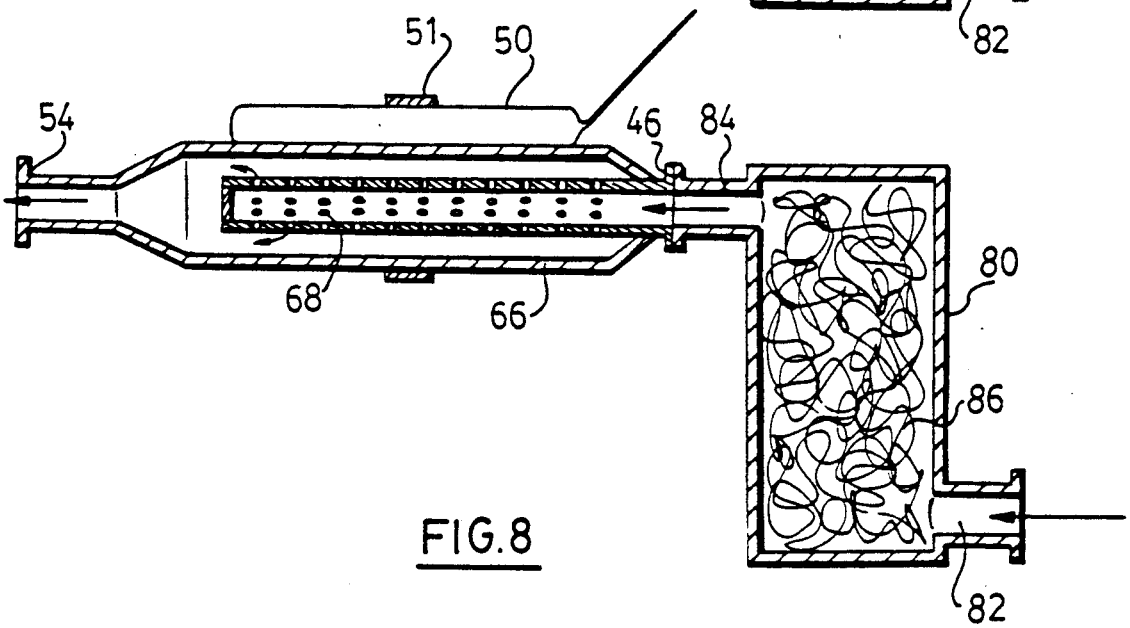
FIG. 8 is a longitudinal cross-section through an apparatus comprising a device of FIG. 7 in series with a device of FIG. 2.

FIG. 8 shows an arrangement in which the device 80 of FIG. 7 is used as a pre-turbulator and pre-mixer for a second downstream device 48, so as again to obtain the combined effect of the two devices.

Figure 9:
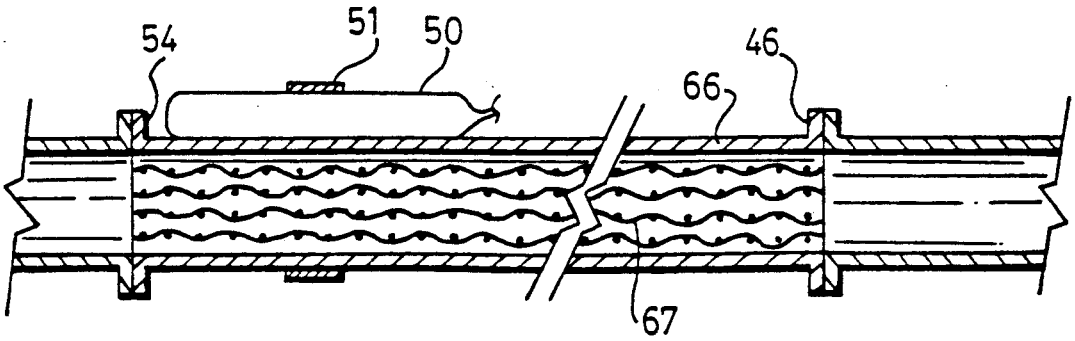
FIG. 9 is a longitudinal cross-section through a device that is a sixth embodiment.

FIG. 9 shows an embodiment in which the device comprises a straight length of pipe 66 the whole interior of which is filled with closely wound wire mesh 67, so that again the entire refrigerant flow is intercepted, rendered sufficiently turbulent and mixed to the necessary extent. Because in this embodiment there is no abrupt change of direction in the flow path, except within the interstices of the wire mesh, the device preferably is made much longer so as to provide a longer path than with the previously described turbulating and mixing devices, the sensor bulb 50 being attached, as with the other embodiments, as close as possible to the outlet end 54. As an example of the additional length required a device fitted in a system with a compressor of 10 H.P. capacity employed a pipe 66 of 4.0 cm (1.6 in.) outside diameter, enclosing a tightly spirally rolled stainless steel mesh; the pipe was 45 cm (18 in.) long, as compared with the length of 20–25 cm (8–10 in.) required for a device 48. However, it may also be noted that in another specific example a device with a straight enclosure between the inlet and the outlet consisted of a piece of pipe 25 cm (10 in.) long and 4 cm (1.6 in.) outside diameter. A piece of permanent aluminum filter material made of woven aluminum strands, as used in air conditioning filters, measuring about 25 cm by 15 cm (10 in. by 6 in.) and 6 mm (0.25 ins.) thick, was rolled tightly into a cylinder and inserted endwise into the pipe. The device was employed with a coil of about 10 H.P. capacity with the sensor bulb fastened to the suction line immediately downstream of the device. Despite its relatively short length it still resulted in an increase of approximately 20% in the cooling capacity of the coil.

I claim:

1. A method for the sensing by temperature sensing means of the temperature of refrigerant exiting from a refrigeration system evaporator coil outlet and for the control in accordance with the sensed temperature of a controllable evaporator valve feeding liquid refrigerant to the evaporator coil inlet, the method comprising:

feeding the refrigerant from the coil outlet to the interior of a turbulating and mixing device which has therein a refrigerant flow path, and which has an exterior wall having opposed interior and exterior surfaces, the exterior wall being of heat conductive material to permit sensing of the device interior flow path temperature through the exterior wall;

producing in the flow path turbulence and mixing of the refrigerant by turbulance and mixing producing means that intercept the entire refrigerant flow, that changes the direction of the entire refrigerant flow, and that directs the entire refrigerant flow by the change of direction to impinge against the interior surface of the exterior wall to ensure turbulence and mixing of all liquid and vapour refrigerant phases present in the refrigerant flow and contact of only mixed phases with the interior surface;

sensing the device interior flow path temperature at the exterior wall exterior surface by temperature sensing means applied to and in heat exchange contact with the wall exterior surface; and controlling the evaporator valve in accordance with the sensed temperature.

2. A method as claimed in claim 1, wherein the turbulating and mixing device receives the refrigerant in a first passage and delivers it to a second passage through a plurality of bores producing an abrupt change in direction of the flow with turbulence producing impingement of the flow through the bores against a first interior surface of the second passage, and wherein the temperature sensing means is applied to and contacts a second exterior surface of the second passage.

3. A method as claimed in claim 2, wherein the refrigerant is introduced into the first passage at one end thereof, and the other end of the first passage is closed for turbulence producing impingement of refrigerant against the closed end before passage through the bores of refrigerant that has impinged against the end wall.

4. A method as claimed in claim 2, wherein the first passage has therein additional turbulating and mixing means intercepting the refrigerant flow in the passage.

5. A method as claimed in claim 4, wherein the additional turbulating and mixing means in the first passage is selected from metallic wool, metallic foam, metallic screen, plastic foam or porous ceramic foam.

6. A method as claimed in claim 1, wherein the turbulating and mixing device comprises conduit means dividing the refrigerant flow into two or more separate turbulent streams and subsequently re-combining the separate streams with impingement against one another to create turbulence and mixing between them, the temperature sensing means being disposed at the point of recombination of the two streams.

7. A method as claimed in claim 6, wherein the conduit means divide the refrigerant into said two or more separate turbulent streams with turbulence producing impingement against a surface transverse to the direction of flow of the refrigerant into the device.

8. A method as claimed in claim 1, wherein the turbulating and mixing device comprises an enclosure having an inlet and an outlet and containing a body of porous turbulating and mixing medium intercepting the entire refrigerant flow and through which the refrigerant passes between the inlet and outlet.

9. A method as claimed in claim 8, wherein the said porous turbulating and mixing medium is selected from metallic wool, metallic foam, metallic screen, plastic foam or porous ceramic foam.

10. A method as claimed in claim 8, wherein the flow direction of the inlet and the outlet to the enclosure are radial to the direction of flow of refrigerant through the enclosure to cause corresponding abrupt changes of direction thereof.

11. A method as claimed in claim 1, and including two turbulating and mixing devices connected in series with one another to increase the turbulence and mixing of the refrigerant and improve temperature sensing, the temperature sensing means being applied to and in heat exchange contact with the exterior wall exterior surface of the downstream device.

12. Apparatus for the sensing by temperature sensing means of the temperature of refrigerant exiting from a refrigeration system evaporator coil outlet and for the control in accordance with the sensed temperature of a controllable evaporator valve feeding liquid refrigerant to the evaporator coil inlet, the apparatus comprising:

a turbulating and mixing device which has an inlet and an outlet for refrigerant, which has therein a refrigerant flow path, and which has an exterior wall having opposed interior and exterior surfaces, the exterior wall being of heat conductive material to permit sensing of the device interior flow path temperature through it;

turbulence and mixing producing means in the flow path intercepting the entire refrigerant flow and creating turbulence and mixing of the refrigerant with change in the direction of the entire refrigerant flow, the turbulence and mixing producing means directing the entire refrigerant flow by the change in direction to impinge against the interior surface of the exterior wall to ensure turbulence and mixing of all liquid and vapour refrigerant phases present and contact of only mixed phases with the interior wall surface;

the appratus having in operation the temperature sensing means in heat conductive contact with the exterior wall exterior surface for sensing the device interior temperature.

13. Apparatus as claimed in claim 12, wherein the turbulence and mixing producing means comprises first and second passages with the exterior wall constituting a wall of the second passage and having a wall in common between them, the said common wall having therein a plurality of bores through which the refrigerant flows from the first passage to the second passage, the bores thereby producing an abrupt change in direction of the flow with impingement of the flow against a first interior surface of the second passage to produce the said turbulence and mixing of the flow in the second passage.

14. Apparatus as claimed in claim 13, wherein the first passage is provided by a first tubular member, and the second passage is provided by a second tubular member providing the exterior wall and surrounding the first tubular member to form an annular second passage between them, the said bores being provided in the wall of the first tubular member and directing the refrigerant flow against the interior wall of the second tubular member.

15. Apparatus as claimed in claim 14, wherein one open end of the first tubular member constitutes an inlet to the first passage, and the other end of the member is closed for turbulence producing impingement of refrigerant against the closed end before passage through the bores of refrigerant that has impinged against the end wall.

16. Apparatus as claimed in claim 13, wherein the first passage is filled with a body of porous turbulating and mixing medium through which the refrigerant must pass from the inlet to the plurality of bores.

17. Apparatus as claimed in claim 16, wherein the said porous turbulating and mixing medium is selected from metallic wool, metallic foam, metallic screen, plastic foam or porous ceramic foam.

18. Apparatus as claimed in claim 12, wherein the turbulating and mixing device comprises first junction means dividing the refrigerant flow into two or more separate streams, second junction means subsequently combining the said separate streams with impingement of the streams against one another to create turbulence and mixing between them, and conduit means connecting the first and second junction means for flow of the separate streams between them, the temperature sensing means being disposed at the second junction.

19. Apparatus as claimed in claim 18, wherein the first junction means divide the refrigerant flow into two or more separate streams with turbulence producing impingement of the streams against a surface of the junction means transverse to the direction of flow of the refrigerant into the device.

20. Apparatus as claimed in claim 12, wherein the turbulating and mixing device comprises an enclosure having an inlet and an outlet and containing within the enclosure a body of porous turbulating and mixing medium through which the refrigerant must pass from the inlet to the outlet.

21. Apparatus as claimed in claim 20, wherein the said porous turbulating and mixing medium is selected from metallic wool, metallic foam, metallic screen, plastic foam or porous ceramic foam.

22. Apparatus as claimed in claim 20, wherein the flow direction of the inlet and the outlet to the enclosure are radial to the direction of flow of refrigerant through the enclosure to cause corresponding abrupt changes of direction thereof.

23. Apparatus as claimed in claim 12, and including two turbulating and mixing device connected in series with one another to increase the turbulence and mixing of the refrigerant and improve temperature sensing, the downstream device in operation having the temperature sensing means applied to and in heat exchange contact with its exterior wall exterior surface.

24. A method as claimed in claim 21, wherein the conduit means divide the refrigerant into said two or more separate turbulent streams with turbulence producing impingement against a surface transverse to the direction of flow of the refrigerant into the device.

25. A method for the control of refrigerant loading in a refrigerator evaporator coil comprising a plurality of circuit coils connected in parallel with one another and all supplied with refrigerant through a common thermostatically controlled refrigerant flow control valve and refrigerant distributor, the valve being controlled to control the refrigerant flow by a superheat temperature sensor detecting the temperature of the refrigerant from all of the circuit coils, the method comprising:

feeding the refrigerant from all of the coil outlets together to the interior of a turbulating and mixing device which has therein a refrigerant flow path, and which has an exterior wall having opposed interior and exterior surfaces, the exterior wall being of heat conductive material to permit sensing of the device interior flow path temperature through the exterior wall;

producing in the flow path turbulence and mixing of the refrigerant by turbulence and mixing producing means that intercept the entire refrigerant flow, that changes the direction of the entire refrigerant flow, and that directs the entire refrigerant flow by the change of direction to impinge against the interior surface of the exterior wall to ensure turbulence and mixing of all liquid and vapour refrigerant phases present in the refrigerant flow, to provide vapourisation of any liquid phase refrigerant present by any superheated vapour phase refrigerant present by any superheated vapour phase refrigerant also present, and contact of only mixed phases with the interior wall surface;

sensing the device interior flow path temperature at the exterior wall exterior surface by temperature sensing means applied to and in heat exchange contact with the wall exterior surface; and controlling the evaporator valve in accordance with the sensed temperature.

26. A method as claimed in claim 25, wherein the turbulating and mixing device receives the refrigerant in a first passage and delivers it to a second passage through a plurality of bores producing an abrupt change in direction of the flow with turbulence producing impingement of the flow through the bores against a first interior surface of the second passage, and wherein the temperature sensing means is applied to and contacts a second exterior surface of the second passage.

27. A method as claimed in claim 26, wherein the refrigerant flow is introduced into the first passage at one end thereof, and the other end of the first passage is closed for turbulence producing impingement of refrigerant against the closed end before passage through the bores of refrigerant that has impinged against the end wall.

28. A method as claimed in claim 26, wherein the first passage has therein additional turbulating and mixing means intercepting the refrigerant flow in the passage.

29. A method as claimed in claim 28, wherein the additional turbulating and mixing means in the first passage is selected from metallic wool, metallic foam, metallic screen, plastic foam or porous ceramic foam.

30. A method as claimed in claim 25, wherein the turbulating and mixing device comprises conduit means dividing the refrigerant flow into two or more separate turbulent streams and subsequently re-combining the separate streams with impingement against one another to create turbulence and mixing between them, the temperature sensing means being disposed at the point of recombination of the two streams.

31. A method as claimed in claim 25, wherein the turbulating and mixing device comprises an enclosure having an inlet and an outlet and containing a body of porous turbulating and mixing medium intercepting the entire refrigerant flow and through which the refrigerant passes between the inlet and outlet.

32. A method as claimed in claim 31, wherein the said porous turbulating and mixing medium is selected from metallic wool, metallic foam, metallic screen, plastic foam or porous ceramic foam.

33. A method as claimed in claim 31, wherein the flow direction of the inlet and the outlet to the enclosure are radial to the direction of flow of refrigerant through the enclosure to cause corresponding abrupt changes of direction thereof.

34. A method as claimed in claim 24, and including two turbulating and mixing devices connected in series with one another to increase the turbulence and mixing of the refrigerant and improve temperature sensing, the temperature sensing means being applied to and in heat exchange contact with the exterior wall exterior surface of the downstream device.

35. Apparatus for use in a refrigeration system which comprises:

a refrigerant compressor;

a condenser coil receiving refrigerant from the compressor to cool it;

a common thermostatically controlled refrigerant flow control valve receiving the cooled refrigerant from the condenser coil;

an evaporator coil comprising a plurality of circuit coils connected in parallel with one another so that all are supplied with refrigerant from the common control valve;

a common member having an inlet and an outlet receiving the refrigerant from all of the circuit coils; and conduit means connecting the compressor, condenser coil, common control valve, evaporator coil, common member inlet, common member outlet and the compressor, in a closed loop in the order stated;

a superheat temperature sensor detecting the temperature of the refrigerant at the common member outlet and operatively connected to the control valve for control thereof in accordance with the sensed temperature;

the apparatus comprising a turbulating and mixing device which has an inlet for connection to the common member outlet and an outlet for the refrigerant, which has therein a refrigerant flow path, and which has an exterior wall having opposed interior and exterior surfaces, the exterior wall being of heat conductive material to permit sensing of the device interior flow path temperature through it;

the device having turbulence and mixing producing means in the flow path intercepting the entire refrigerant flow path and creating turbulence and mixing of the refrigerant with change in the direction of the entire refrigerant flow, the turbulence and mixing producing means directing the entire refrigerant flow by the change in direction to impinge against the interior surface of the exterior wall to ensure turbulence and mixing of all liquid and vapour refrigerant phases present and contact of only mixed phases with the interior wall surface; and the apparatus in operation having the superheat temperature sensor in heat conductive contact with the exterior wall exterior surface.

36. Apparatus as claimed in claim 35, wherein the turbulence and mixing producing means comprises first and second passages with the exterior wall constituting a wall of the second passage and having a wall in common between them, the said common wall having therein a plurality of bores through which the refrigerant flows from the first passage to the second passage, the bores thereby producing an abrupt change in direction of the flow with impingement of the flow against a first interior surface of the second passage to produce turbulence and mixing of the flow in the second passage.

37. Apparatus as claimed in claim 36, wherein the first passage is provided by a first tubular member, and the second passage is provided by a second tubular member providing the exterior wall and surrounding the first tubular member to form an annular second passage between them, the said bores being provided in the wall of the first tubular member, and directing the refrigerant flow against the interior wall of the second tubular member.

38. Apparatus as claimed in claim 37, wherein one open end of the first tubular member constitutes an inlet to the first passage, and the other end of the member is closed for turbulence producing impingement of refrigerant against the closed end before passage through the bores of refrigerant that has impinged against the end wall.

39. Apparatus as claimed in claim 36, wherein the first passage is filled with a body of porous turbulating and mixing medium through which the refrigerant must pass from the inlet to the plurality of bores.

40. Apparatus as claimed in claim 39, wherein the said porous turbulating and mixing medium is selected from metallic wool, metallic foam, metallic screen, plastic foam or porous ceramic foam.

41. Apparatus as claimed in claim 35, wherein the turbulating and mixing device comprises first junction means dividing the refrigerant flow into two or more separate streams, second junction means subsequently combining the said separate streams with impingement of the streams against one another to create turbulence and mixing between them, and conduit means connecting the first and second junction means for flow of the separate streams between them, the temperature sensing means being disposed at the record junction.

42. Apparatus as claimed in claim 41, wherein the first junction means divide the refrigerant flow into two or more separate streams with turbulence producing impingement of the streams against a surface of the junction means transverse to the direction of flow of the refrigerant into the device.

43. Apparatus as claimed in claim 35, wherein the turbulating and mixing device comprises an enclosure having an inlet and an outlet and containing within the enclosure a body of porous turbulating and mixing medium through which the refrigerant must pass from the inlet to the outlet.

44. Apparatus as claimed in claim 43, wherein the said porous turbulating and mixing medium is selected from metallic wool, metallic foam, metallic screen, plastic foam or porous ceramic foam.

45. Apparatus as claimed in claim 35, wherein the flow direction of the inlet and the outlet to the enclosure are radial to the direction of flow of refrigerant through the enclosure to cause corresponding abrupt changes of direction thereof.

46. Apparatus as claimed in claim 35, and including two turbulating and mixing devices connected in flow series with one another to increase the turbulence and mixing of the refrigerant and improve temperature sensing, the downstream device in operation having the superheat temperature sensor applied to and in heat exchange contact with its exterior wall exterior surface.

* * * * *